US009974369B1

(12) United States Patent
DePaolo et al.

(10) Patent No.: US 9,974,369 B1
(45) Date of Patent: May 22, 2018

(54) APPARATUS FOR ANCHORING AN UMBRELLA

(71) Applicants: Michael DePaolo, Mashpee, MA (US); Reneta Georgieva, Mashpee, MA (US)

(72) Inventors: Michael DePaolo, Mashpee, MA (US); Reneta Georgieva, Mashpee, MA (US)

( * ) Notice: Subject to any disclaimer, the term of this patent is extended or adjusted under 35 U.S.C. 154(b) by 0 days. days.

(21) Appl. No.: 15/292,454

(22) Filed: Oct. 13, 2016

(51) Int. Cl.

| | |
|---|---|
| ***A45B 11/00*** | (2006.01) |
| ***A45B 23/00*** | (2006.01) |
| ***E04H 12/22*** | (2006.01) |
| *A45B 25/00* | (2006.01) |

(52) U.S. Cl.
CPC ..... *A45B 11/00* (2013.01); *A45B 23/00* (2013.01); *E04H 12/2246* (2013.01); *A45B 2023/0012* (2013.01); *A45B 2025/003* (2013.01)

(58) Field of Classification Search
CPC . A45B 2023/0012; A45B 23/00; A45B 11/00; A45B 2025/003; A45B 2017/005; A45B 25/22; A45B 3/08; E04H 12/22
USPC ..... 135/16, 98; 211/197; 248/519, 529, 165, 248/188.4, 523
See application file for complete search history.

(56) References Cited

U.S. PATENT DOCUMENTS 3,119,585 A * 1/1964 Austenson ..... A47G 33/1213 248/219.3
3,119,588 A * 1/1964 Keats ..... E01F 13/02 116/173
3,796,453 A * 3/1974 Grimes ..... E01H 1/1206 15/257.2
4,050,401 A * 9/1977 Kelly ..... E01F 13/02 116/63 P
6,113,054 A * 9/2000 Ma ..... E04H 12/2238 248/158
6,199,818 B1 * 3/2001 Tsappi ..... A01G 9/124 248/516
6,223,759 B1 * 5/2001 Flippin, Jr. ..... A45B 5/00 135/16
6,446,649 B1 9/2002 Bigford
6,666,427 B2 * 12/2003 Hennessey ..... F16M 11/28 248/125.8
6,732,985 B1 * 5/2004 Cantrell ..... A45F 3/44 248/125.1
6,895,982 B1 5/2005 Shaw
7,347,428 B2 * 3/2008 Edenso ..... A01G 9/02 135/15.1
2002/0028716 A1 * 3/2002 Gormley ..... E04H 12/2246 473/423

(Continued)

*Primary Examiner* — Winnie Yip

(57) ABSTRACT

An apparatus for anchoring an umbrella including a container base and a cylindrical male attachment member medially attached and upwardly extended from a flattened middle portion of the container base. The cylindrical male attachment member has an inner threaded cavity. An umbrella shaft has an umbrella canopy attached to a top end and a threaded exterior portion disposed proximal a bottom end. The threaded exterior portion of the umbrella shaft is selectively threadable engageable with the inner threaded cavity of the cylindrical male attachment member. A hook is attached to the umbrella shaft proximal the top end, and a shovel is removably attachable to the hook. The inner chamber of the container base is fillable with a weighty substance that can include, but not be limited to, sand.

4 Claims, 5 Drawing Sheets

(56) References Cited

U.S. PATENT DOCUMENTS

| | | | | |
|---|---|---|---|---|
| 2005/0189005 | A1* | 9/2005 | Smith | G09F 23/00 135/16 |
| 2006/0016950 | A1* | 1/2006 | Bright | E04H 12/2246 248/346.03 |
| 2012/0055893 | A1* | 3/2012 | Wisniewski | A47G 25/0664 211/85.3 |

* cited by examiner

APPARATUS FOR ANCHORING AN UMBRELLA

BACKGROUND OF THE INVENTION

Various types of umbrella stands are known in the prior art. However, what has been needed is an apparatus for anchoring an umbrella including a container base and a cylindrical male attachment member medially attached and upwardly extended from a flattened middle portion of the container base, with the cylindrical male attachment member having an inner threaded cavity. What has been further needed is an umbrella shaft having an umbrella canopy attached to a top end and a threaded exterior portion disposed proximal a bottom end, with the threaded exterior portion of the umbrella shaft selectively threadable engageable with the inner threaded cavity of the cylindrical male attachment member. Lastly, what has been needed is a hook attached to the umbrella shaft proximal the top end and a shovel removably attachable to the hook. The inner chamber of the container base is fillable with a weighty substance that can include, but not be limited to, sand. The apparatus for anchoring an umbrella thus provides a uniquely structured portable way in which to keep a beach umbrella more secure and stable through the weighty substance disposed within the inner chamber of the container base. The removable shovel provides additional assistance to a user in filling the inner chamber of the container base with the weighty substance.

FIELD OF THE INVENTION

The present invention relates to umbrella stands, and more particularly, to an apparatus for anchoring an umbrella.

SUMMARY OF THE INVENTION

The general purpose of the present apparatus for anchoring an umbrella, described subsequently in greater detail, is to provide an apparatus for anchoring an umbrella which has many novel features that result in an apparatus for anchoring an umbrella which is not anticipated, rendered obvious, suggested, or even implied by prior art, either alone or in combination thereof.

To accomplish this, the present apparatus for anchoring an umbrella includes a container base, optionally plastic for durability, having a flattened middle portion, a continuous wall disposed along an entirety of an outer surface of the flattened middle portion, and an inner chamber disposed between the continuous wall. The continuous wall has a first height less than a diameter of the flattened middle portion. The flattened middle portion of the container base is optionally disk-shaped. A cylindrical male attachment member having a second height is medially attached and upwardly extended from the flattened middle portion of the container base. The cylindrical male attachment member has an upper end and an inner threaded cavity disposed within the upper end. The structure of the container base, in particular the height of the continuous wall being less than the diameter of the flattened middle portion, allows for the container base to be easily buried and covered flush with a surrounding ground surface. The second height of the cylindrical male attachment member is greater than the first height of the continuous wall, allowing the upper end and the inner threaded cavity to be exposed even when the container base is fully buried.

The apparatus for anchoring an umbrella further includes an umbrella shaft having a top end, a bottom end, a third height, an umbrella canopy attached to the top end, a lip member continuously disposed around the umbrella shaft proximal the bottom end, and a threaded exterior portion disposed from the lip member to the bottom end. The third height is at least four times the first height of the continuous wall in order to maximize a shaded area created underneath the umbrella canopy in which a user can sit. A circumference of the lip member of the umbrella shaft substantially conforms to a circumference of the cylindrical male attachment member. The threaded exterior portion of the umbrella shaft is selectively threadable engageable with the inner threaded cavity of the cylindrical male attachment member.

Lastly, a hook is attached to the umbrella shaft proximal the top end, and a shovel is removably attachable to the hook. The inner chamber of the container base is fillable with a weighty substance that can include, but not be limited to, sand. The weighty substance ensures that the container base remains firmly grounded, and the shovel removably attachable to the hook attached to the umbrella shaft assists a user in more easily burying the container base or filling the inner chamber of the container base with sand while relaxing at the beach.

Thus has been broadly outlined the more important features of the present apparatus for anchoring an umbrella so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
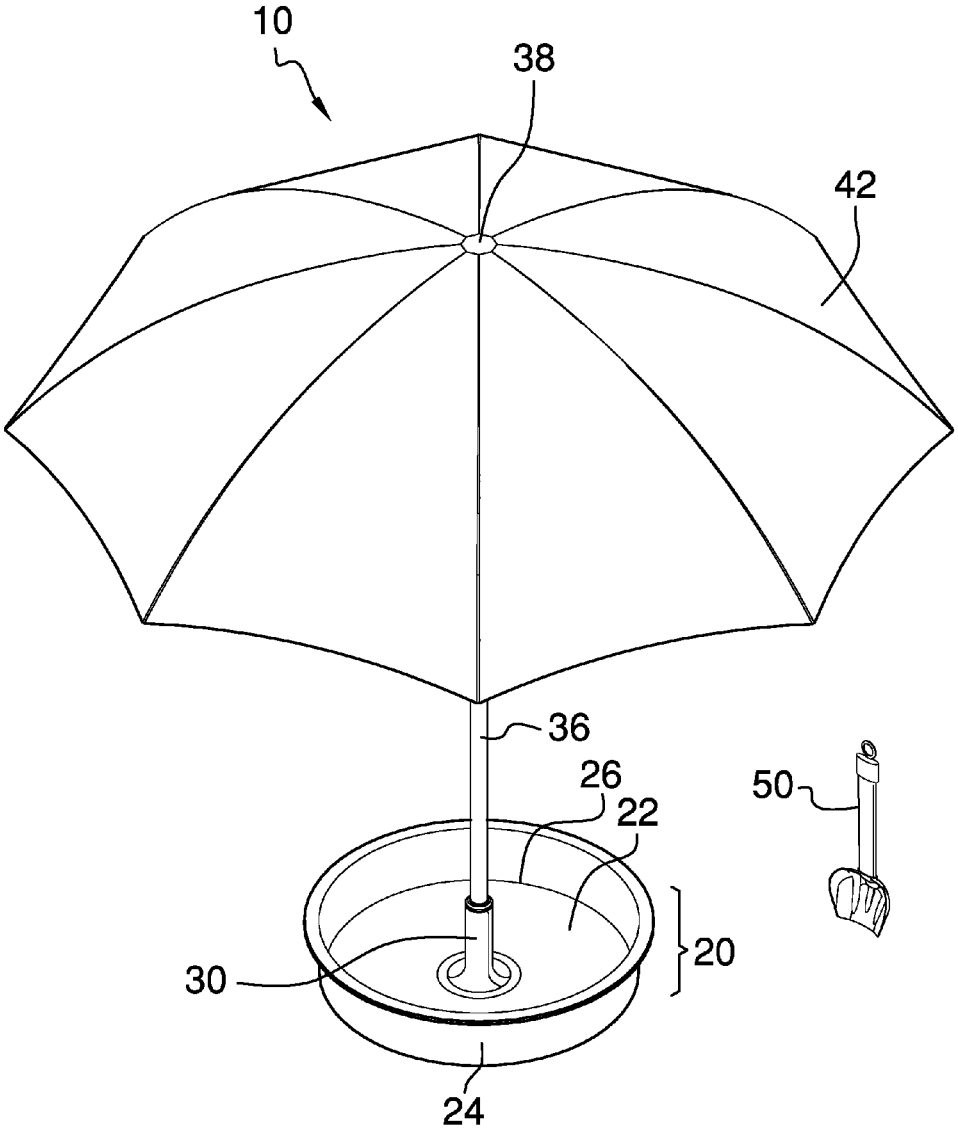
FIG. 1 is a front isometric view.
Figure 2:
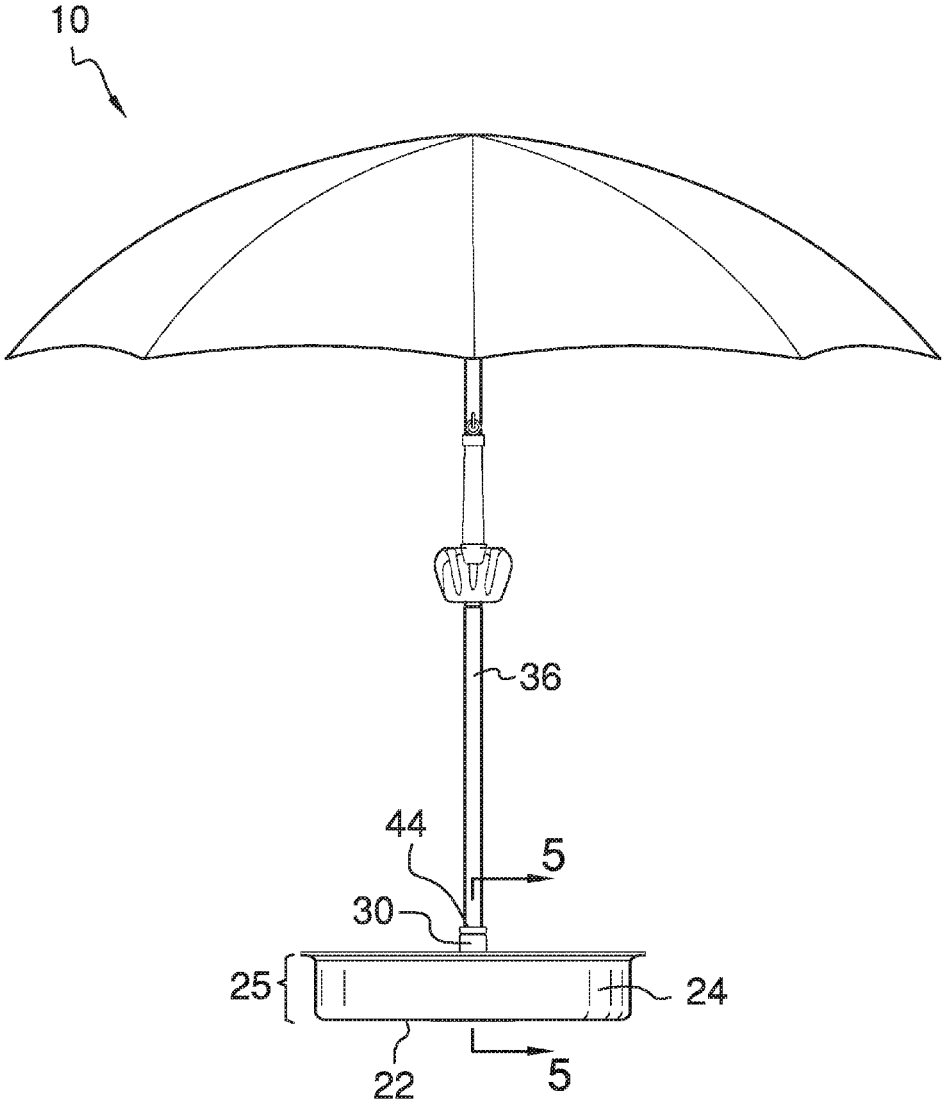
FIG. 2 is a front elevation view.
Figure 3:
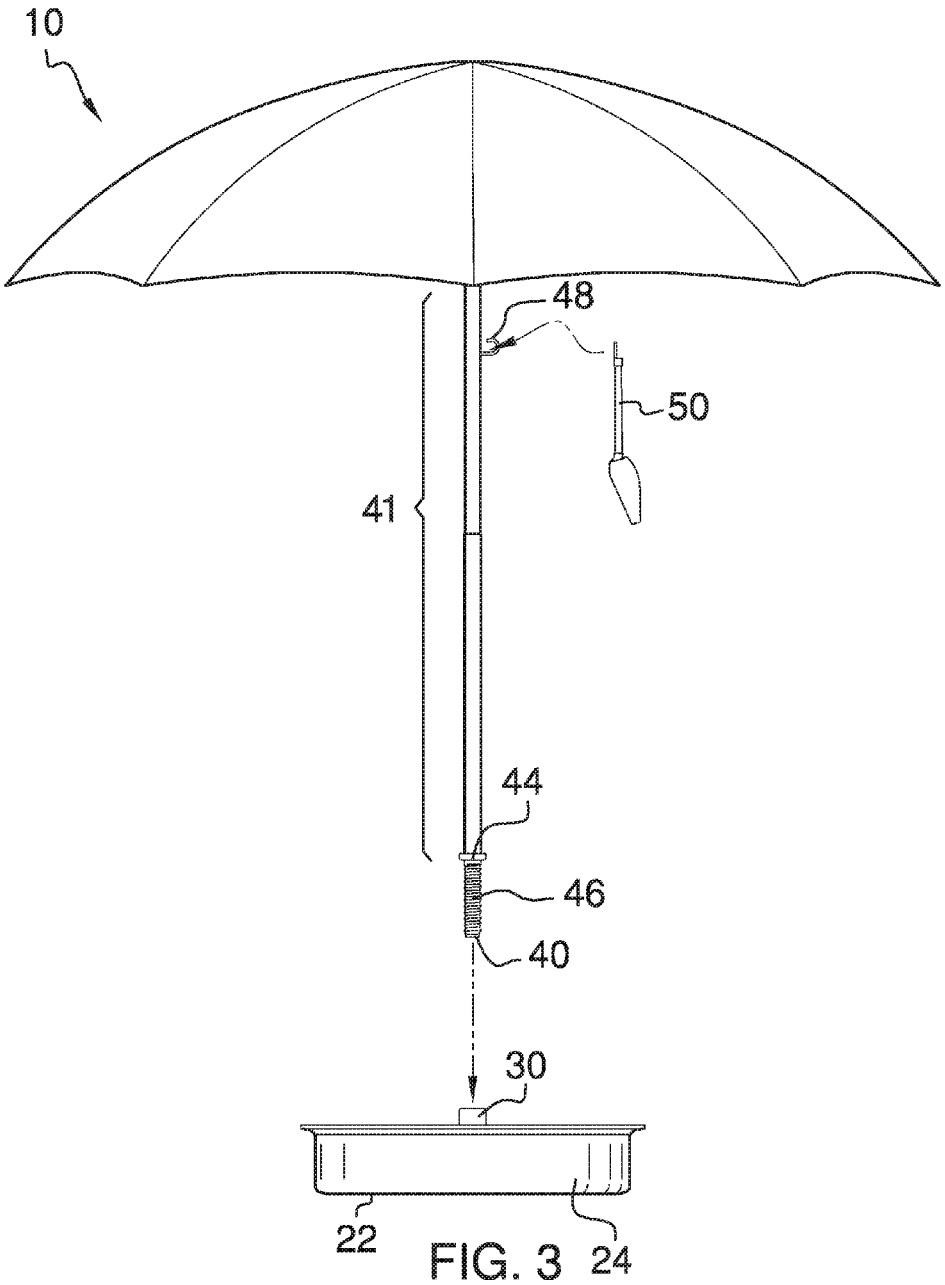
FIG. 3 is a side elevation view.
Figure 4:
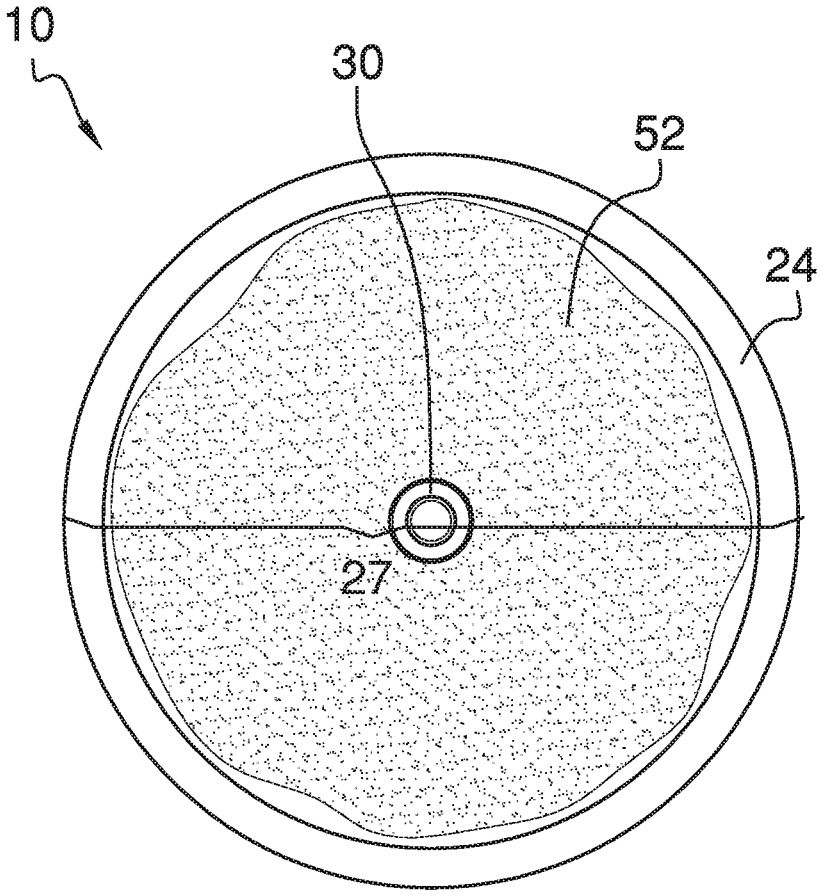
FIG. 4 is a top plan view.
Figure 5:
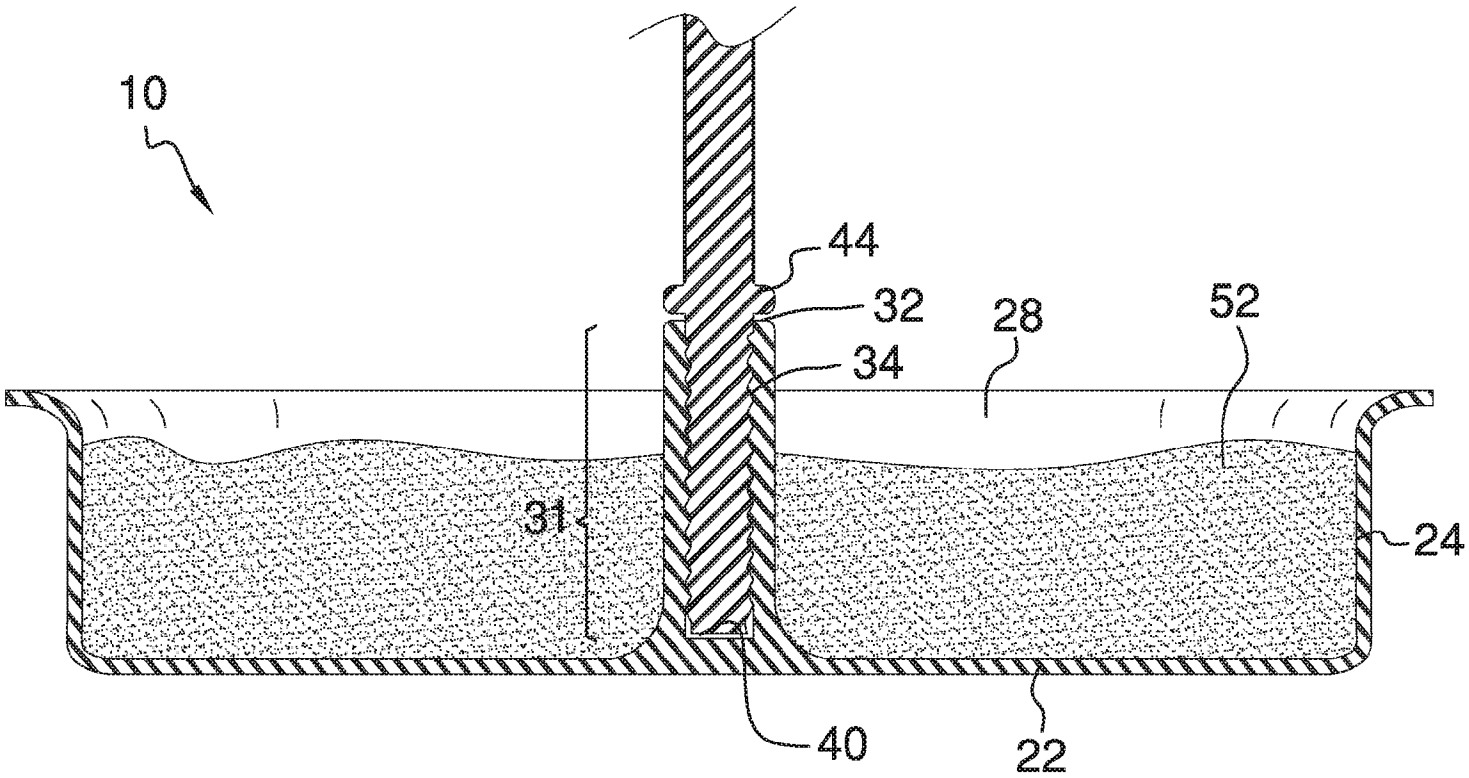
FIG. 5 is a cross-sectional view taken along line 5-5 of FIG. 3.

With reference now to the drawings, and in particular FIGS. 1 through 5 thereof, an example of the instant apparatus for anchoring an umbrella employing the principles and concepts of the present apparatus for anchoring an umbrella and generally designated by the reference number 10 will be described.

Referring to FIGS. 1 through 5 the present apparatus for anchoring an umbrella 10 is illustrated. The apparatus for anchoring an umbrella 10 includes a container base 20 having a flattened middle portion 22, a continuous wall 24 disposed along an entirety of an outer surface 26 of the flattened middle portion 22, and an inner chamber 28 disposed between the continuous wall 24. The continuous wall has a first height 25 less than a diameter 27 of the flattened middle portion. The flattened middle portion 22 of the container base 20 is optionally disk-shaped. A cylindrical male attachment member 30 having a second height 31 is medially attached and upwardly extended from the flattened middle portion 22 of the container base 20. The second height 31 of the cylindrical male attachment member is greater than the first height 25 of the continuous wall. The cylindrical male attachment member 30 has an upper end 32 and an inner threaded cavity 34 disposed within the upper end 32.

The apparatus for anchoring an umbrella 10 further includes an umbrella shaft 36 having a top end 38, a bottom end 40, a third height 41, an umbrella canopy 42 attached to the top end 38, a lip member 44 continuously disposed around the umbrella shaft 36 proximal the bottom end 40, and a threaded exterior portion 46 disposed from the lip member 44 to the bottom end 40. The third height 41 is at least four times the first height 25 of the continuous wall. A circumference of the lip member 44 of the umbrella shaft 36 substantially conforms to a circumference of the cylindrical male attachment member 30. The threaded exterior portion 46 of the umbrella shaft 36 is selectively threadable engageable with the inner threaded cavity 34 of the cylindrical male attachment member 30.

Lastly, a hook 48 is attached to the umbrella shaft 36 proximal the top end 38, and a shovel 50 is removably attachable to the hook 48. The inner chamber 28 of the container base 20 is fillable with a weighty substance 52 that can include, but not be limited to, sand.

What is claimed is:

1. An apparatus for anchoring an umbrella comprising:

a container base having a flattened middle portion, a continuous wall disposed along an entirety of an outer surface of the flattened middle portion, and an inner chamber disposed between the continuous wall, wherein the continuous wall has a first height less than a diameter of the flattened middle portion, wherein the container base is configured to be buried and covered flush with a ground surface;

a cylindrical male attachment member having a second height, wherein the cylindrical male attachment member is medially attached and upwardly extended from the flattened middle portion of the container base, the cylindrical male attachment member having an upper end and an inner threaded cavity disposed within the upper end, wherein the second height is greater than the first height of the continuous wall;

an umbrella shaft having a top end, a bottom end, a third height, an umbrella canopy attached to the top end, a lip member continuously disposed around the umbrella shaft proximal the bottom end, and a threaded exterior portion disposed from the lip member to the bottom end, wherein the third height is at least four times the first height of the continuous wall;

wherein a circumference of the lip member of the umbrella shaft substantially conforms to a circumference of the cylindrical male attachment member;

wherein the threaded exterior portion of the umbrella shaft is selectively threadable engageable with the inner threaded cavity of the cylindrical male attachment member;

a hook attached to the umbrella shaft proximal the top end; and a shovel removably attachable to the hook;

wherein the inner chamber of the container base is fillable with a weighty substance.

2. The apparatus for anchoring an umbrella of claim 1 wherein the flattened middle portion of the container base is disk-shaped.

3. The apparatus for anchoring an umbrella of claim 2 wherein the weighty substance is sand.

4. The apparatus for anchoring an umbrella of claim 3 wherein the container base is plastic.

* * * * *